US007950448B2

(12) United States Patent
Bruins et al.

(10) Patent No.: US 7,950,448 B2
(45) Date of Patent: May 31, 2011

(54) COMBINED FTC SUPPORT SYSTEM

(75) Inventors: Matt Bruins, Medicine Hat (CA); Brendon Hamilton, Medicine Hat (CA)

(73) Assignee: Hitman Holdings Ltd., Medicine Hat (CA)

( * ) Notice: Subject to any disclaimer, the term of this patent is extended or adjusted under 35 U.S.C. 154(b) by 121 days.

(21) Appl. No.: 12/409,352

(22) Filed: Mar. 23, 2009

(65) Prior Publication Data

US 2009/0308589 A1 Dec. 17, 2009

(30) Foreign Application Priority Data

Jun. 11, 2008 (CA) ..... 2634860

(51) Int. Cl.
*E21B 43/26* (2006.01)

(52) U.S. Cl. ..... 166/75.11; 166/90.1; 166/177.5

(58) Field of Classification Search ..... 166/75.11, 166/90.1, 177.5
See application file for complete search history.

(56) References Cited

U.S. PATENT DOCUMENTS

| | | | | |
|---|---|---|---|---|
| 4,159,180 | A | 6/1979 | Cooper et al. | |
| 5,006,034 | A * | 4/1991 | Bragg et al. | 414/555 |
| 6,193,402 | B1 | 2/2001 | Grimland et al. | |
| 2003/0161212 | A1 * | 8/2003 | Neal et al. | 366/10 |
| 2006/0289166 | A1 * | 12/2006 | Stromquist et al. | 166/305.1 |
| 2009/0050311 | A1 * | 2/2009 | Crawford | 166/90.1 |
| 2010/0086388 | A1 * | 4/2010 | Guidry | 414/495 |

OTHER PUBLICATIONS

Office Action from Canadian Patent Office for related Application No. 2,634,860 dated May 7, 2010, 2 pages.

* cited by examiner

*Primary Examiner* — William P Neuder
(74) *Attorney, Agent, or Firm* — Klarquist Sparkman, LLP

(57) ABSTRACT

A combined system for treating an oil or gas well is provided which includes a truck, having a truck bed attached thereto and a fracturing support unit and an iron skid mounted on the truck bed. The fracturing support unit includes well head control equipment, and the iron skid includes a manifold having an arrangement of valves for controlling the flow of fluid to the well. The iron skid may be advantageously articulated off the truck bed and onto the ground for unloading the iron components used to treat the well.

22 Claims, 7 Drawing Sheets

COMBINED FTC SUPPORT SYSTEM

RELATED APPLICATION DATA

This application claims priority to Canada Patent Application No. 2,634,860, filed Jun. 11, 2008, which is incorporated herein by reference.

FIELD

The present invention relates to hydraulic fracturing through coil ("FTC") systems and to standard fracturing systems for the oil and gas industry and more specifically to a combined support system for the servicing of oil and gas wells.

BACKGROUND

Fracturing ("frac") operations are used in the oil and gas industry to stimulate the production of oil and gas wells. Such operations require a large array of heavy machinery, which is typically brought to a well site by individual trucks, and assembled on site.

This approach has several disadvantages. Most obviously, the cost of operating multiple rigs is high because of the redundant personnel, fuel, and equipment expenditures associated with this approach. Another disadvantage of this approach is its environmental impact, primarily due to the large emissions and surface damage caused by multiple trucks. There are also safety issues inherent in connecting components from a variety of trucks at a well site, involving the assembly and disassembly of connections with both low and high pressure piping.

One such safety issue is the danger involved in removing long iron joints off of an iron trailer, where the joints are higher than a worker's head. Normally, these joints, which weigh anywhere from 45 to 200 pounds are handled manually by workers. This forces the workers to stand inside the wheels of a trailer to get enough leverage to remove the joints.

Accordingly, there is a need for a system and method for providing fracturing machinery to a well site which eliminates or alleviates the above disadvantages.

SUMMARY

The combined FTC support system described herein by the applicant seeks to overcome the above disadvantages by providing three systems used in fracturing operations on a single truck. Specifically the present combined FTC support system provides a fracturing support unit, an iron skid, and a manifold on a single truck.

Therefore, in accordance with one aspect, there is provided a combined system for treating an oil or gas well, comprising: a truck, having a truck bed attached to thereto; and a fracturing support unit and an iron skid mounted on the truck bed, the iron skid comprising a manifold.

In operation, the combined FTC support system of the present invention is driven to a well site requiring fracturing and the fracturing support unit, the iron skid, and the manifold are deployed as discussed below and operated according to standard procedures known in the art.

The combined FTC support system overcomes the disadvantages of the prior art by greatly reducing the number of trailer-truck loads that must be transported to a well site, thereby reducing fuel consumption, engine emissions, surface damage and costs, on a per well basis. The combined FTC support system also requires less assembly and disassembly for each job than the previously known systems, thereby increasing efficiency and safety.

The combined FTC system may further improve safety by providing an articulating iron skid, which may be lowered to ground level, bringing the iron joints to waist height, making them safer to handle by workers. The configuration of the articulating iron skid also facilitates an efficient field layout.

Therefore, in accordance with another aspect, there is provided an articulating iron skid attachable to a truck bed for use in treating an oil or gas well, the iron skid comprising: a rack bed and a rack mounted thereto for holding high pressure treating iron components; an elevating ramp designed for pivotal connection to the truck bed, the rack bed being slidably connected to the elevating ramp; a pair of hydraulic cylinders for further connecting the elevating ramp to the truck bed, the cylinders for raising and lowering a first end of the elevating ramp between a first lowered position to a second raised position; wherein the articulating iron skid is configured to slide from the first end of the elevating ramp to a second end of the elevating ramp when the first end of the elevating ramp is raised to the second raised position by the hydraulic cylinders, thereby lowering the iron skid from the truck bed to ground level.

Accordingly, there is described herein embodiments of the applicant's combined system.

It is to be understood that other aspects of the present combined FTC support system will become readily apparent to those skilled in the art from the following detailed description, wherein various embodiments are shown and described by way of illustration. As will be realized, the combined FTC support system is capable of other and different embodiments and its several details are capable of modification in various other respects, all without departing from the spirit and scope of the combined FTC support system described. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the applicant's combined FTC support system are illustrated by way of example, and not by way of limitation, in detail in the figures, wherein.

DETAILED DESCRIPTION

The applicant's combined FTC support system is herein described in detail.

Figure 1:
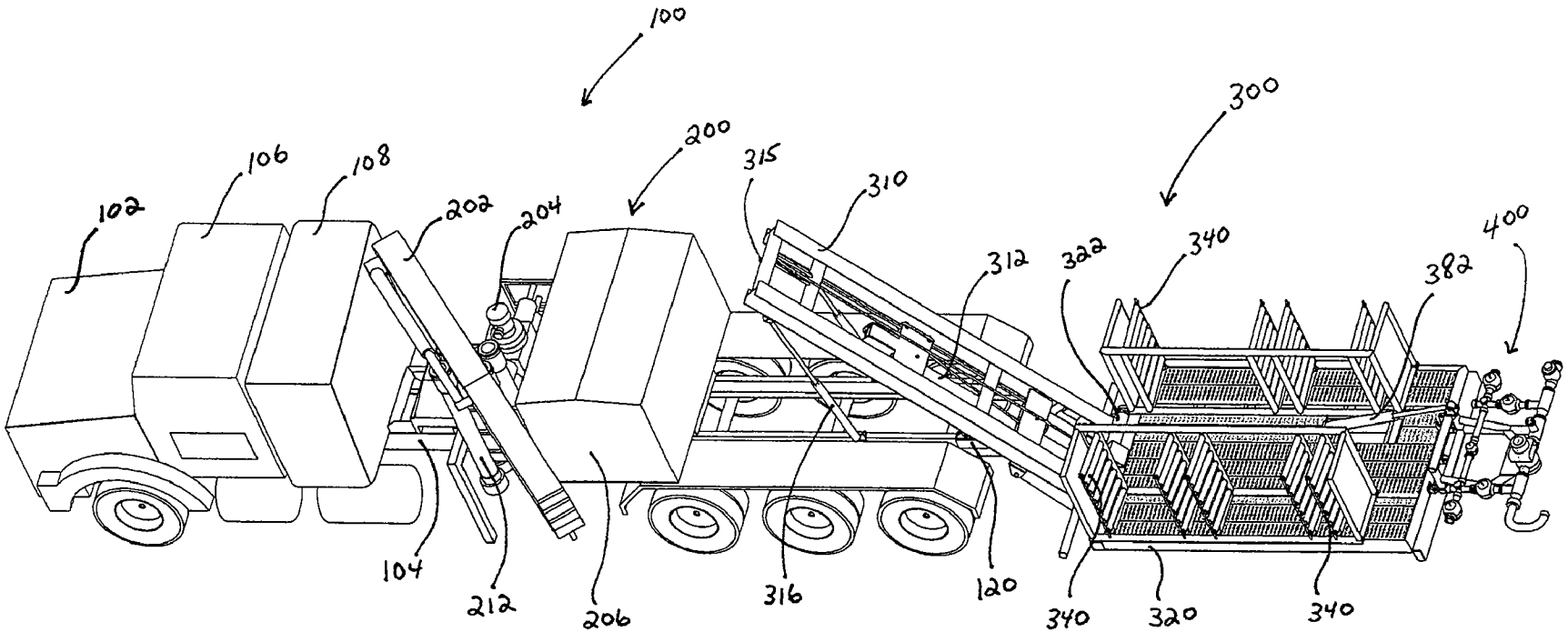
FIG. 1 shows a left-side perspective view of one aspect of the applicant's combined FTC support system, wherein the iron skid is articulated to the ground.

FIG. 1 shows one embodiment of the applicant's combined FTC support system 100, which comprises a truck 102, having a main cabin 106 and a truck bed 104 attached to the truck. As is known in the art, the truck may also include a sleeper cabin 108 adjacent the main cabin 106. The truck 102 further includes either a gasoline or diesel engine, which is used to move the combined FTC support system 100 about and power the hydraulic components, which may be connected by way of the truck's power take-off ("PTO").

Behind the sleeper cabin 108 (if included), the fracturing equipment of the combined FTC support system 100 is disposed on the trailer bed 104 in the following order: a fracturing support unit 200, an iron skid 300, and a manifold 400. The combined FTC support system is not limited to this specific ordering of components, however, for reasons which shall be discussed below, the applicant has found this ordering to be advantageous.

Fracturing Support Unit

Figure 3:
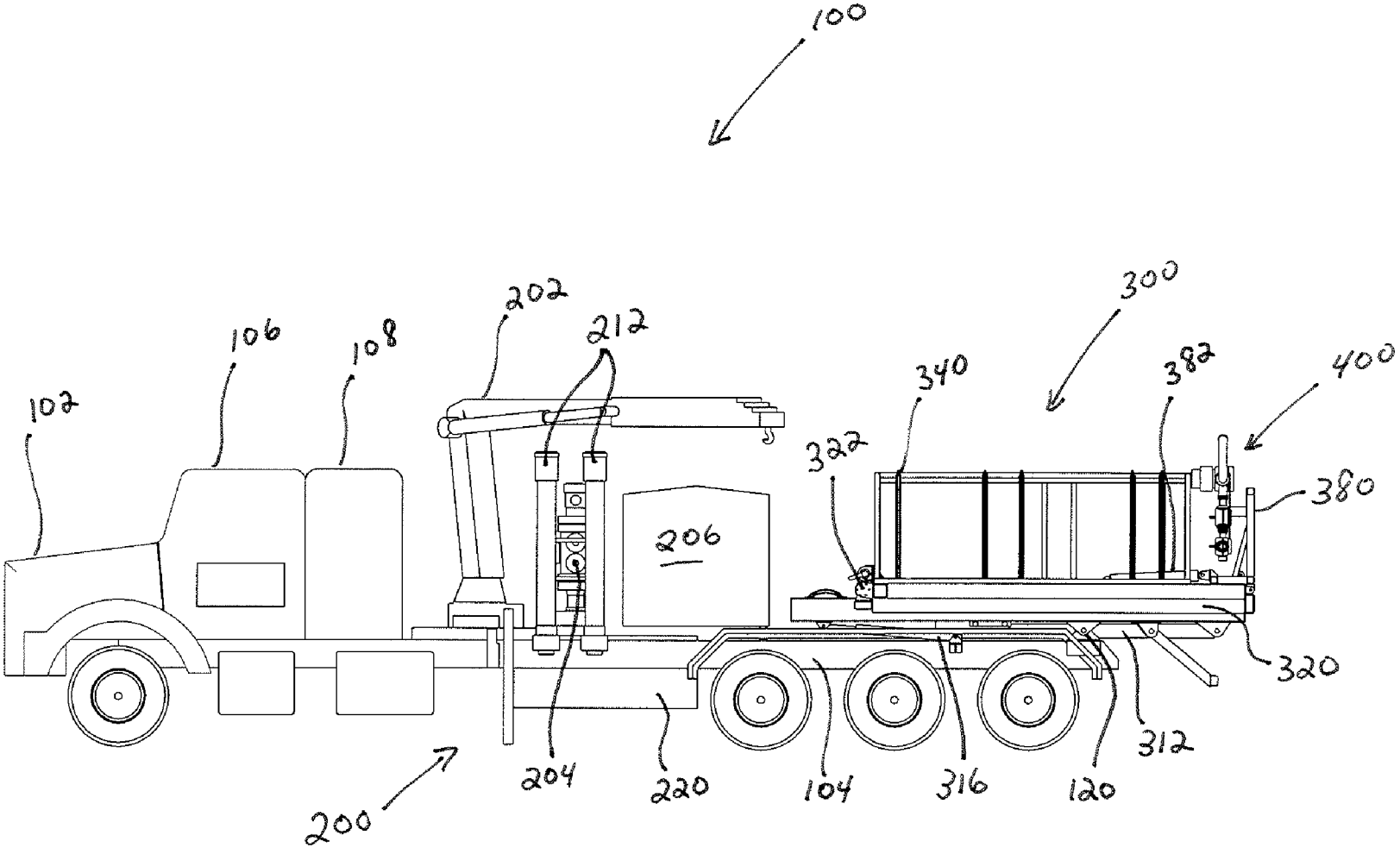
FIG. 3 shows a left-side elevation view of the combined FTC support system, wherein the iron skid is positioned on the truck bed.

The fracturing support unit 200 is positioned on the truck bed 104, preferably adjacent the sleeper cabin 108, and includes a crane 202, well head control equipment, as is known in the art, one or more blow out preventers ("BOPs") 204, an air compressor 206, lubricators 212, and toolboxes 220 (FIG. 3). Other fracturing support equipment may also be included in the fracturing support unit 200, and the applicant's combined FTC support system is not limited to the specific equipment described herein.

The crane 202 is for moving equipment off of and onto the truck bed 104, such as for example, the BOPs 204. The air compressor 206 may be used, as is known in the art, for winter fracturing operations.

Iron Skid

Figure 5:
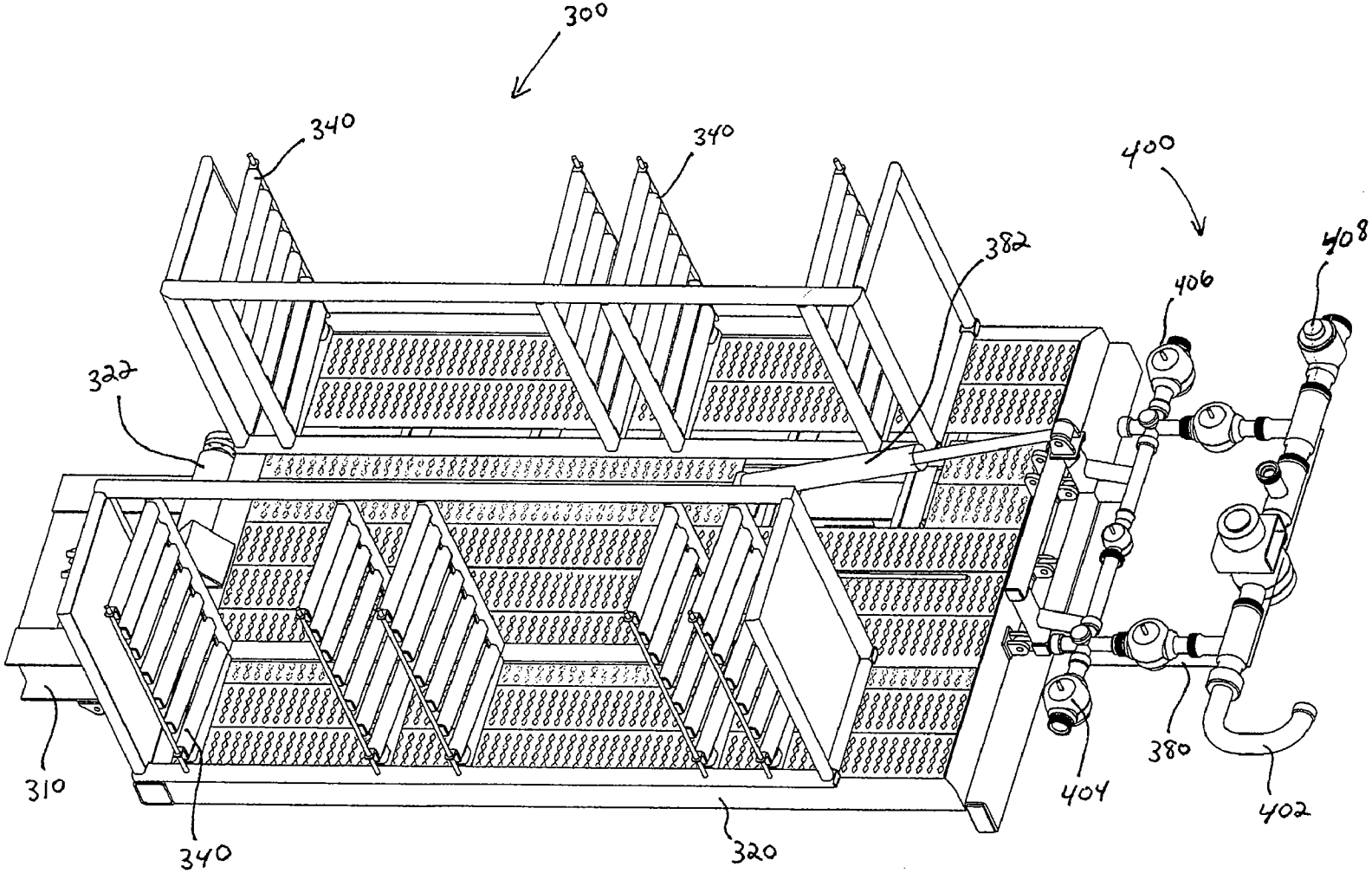
FIG. 5 shows a perspective view of an iron skid according to one aspect of the applicant's combined FTC support system.
Figure 6:
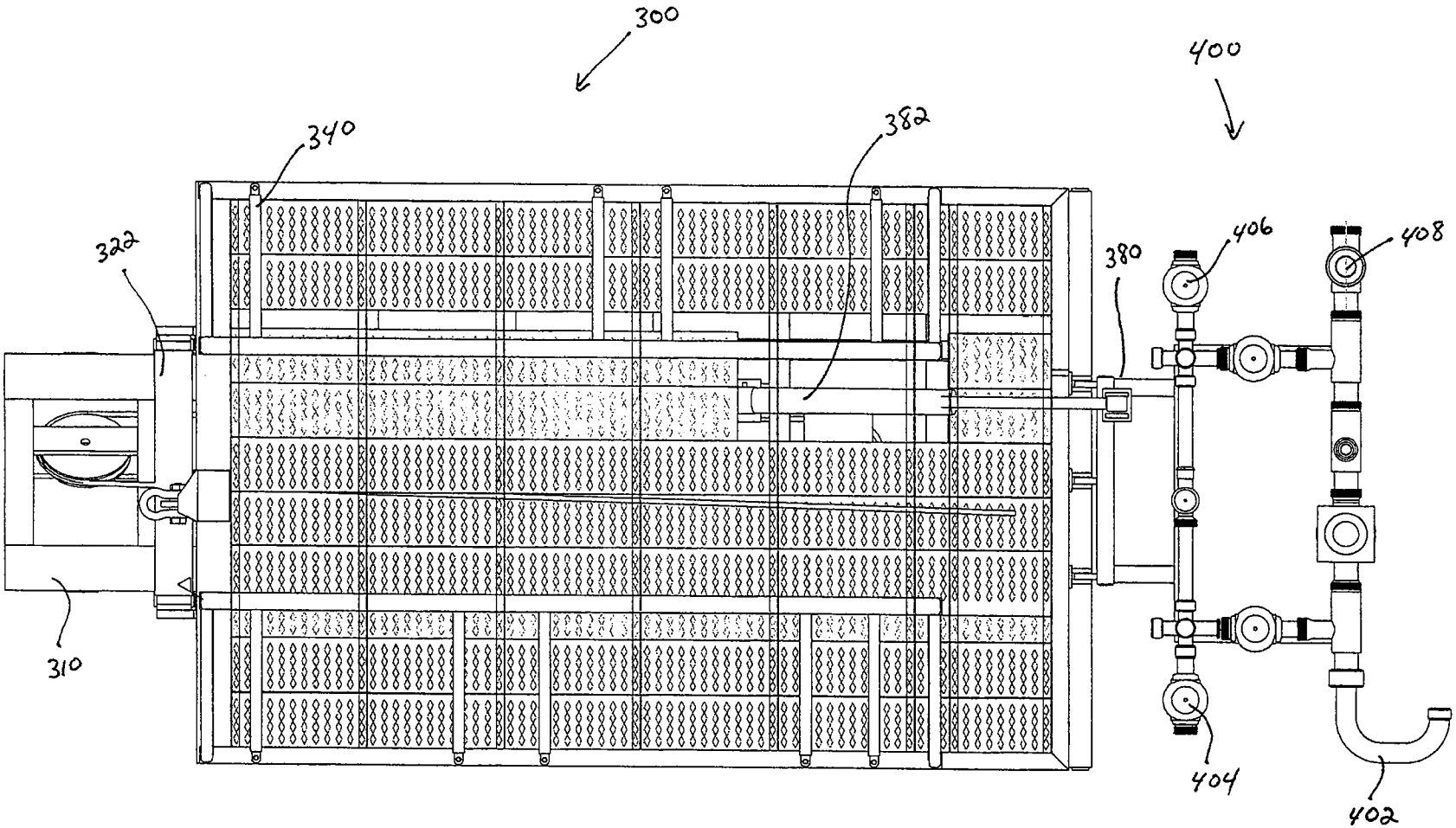
FIG. 6 shows a top plan view of the iron skid shown in FIG. 5.
Figure 7:
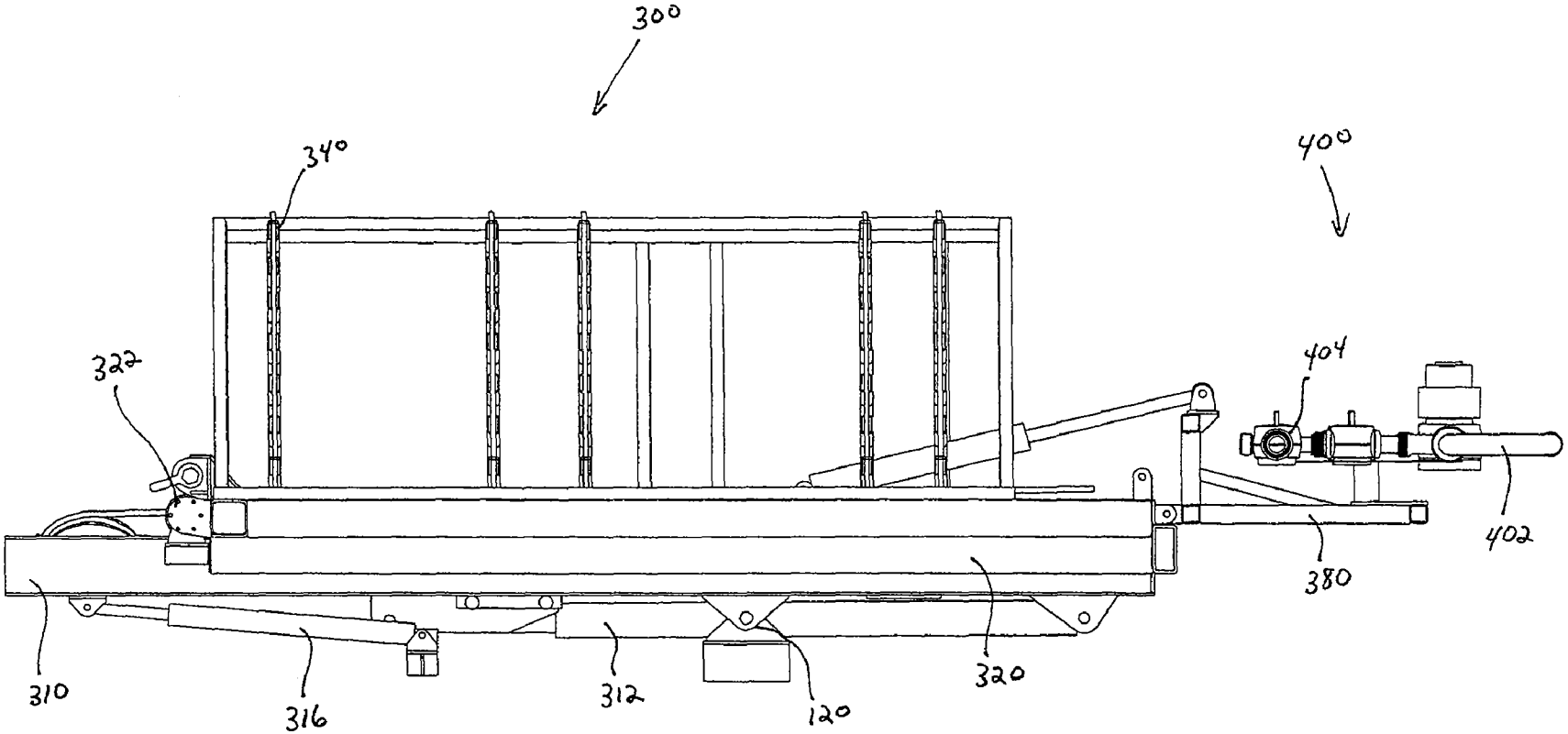
FIG. 7 shows a side elevation view of the iron skid shown in FIG. 5

An iron skid 300 may be positioned at the back of the truck bed 104, and is shown in greater detail in FIGS. 5, 6 and 7. While conventional iron skids are within the scope of the applicant's combined FTC support system, the iron skid 300 described herein by the applicant is an articulating iron skid, which may be lowered off the truck bed 104 to ground level, as shown in FIG. 1 and discussed below.

The articulating iron skid 300 includes a rack bed 320 for mounting the iron skid on the truck bed 104. The rack bed 320 is slidingly engaged with an elevating ramp 310, as seen in FIG. 1. Elevating ramp 310 is pivotally connected to the truck bed 104 by hinges 120, and is further connected near a first end 315 of the ramp by a pair of hydraulic cylinders 316 for raising the first end 315 of the elevating ramp 310 from a lowered position as shown in FIGS. 2 to 4, to a raised position as shown in FIG. 1.

Figure 2:
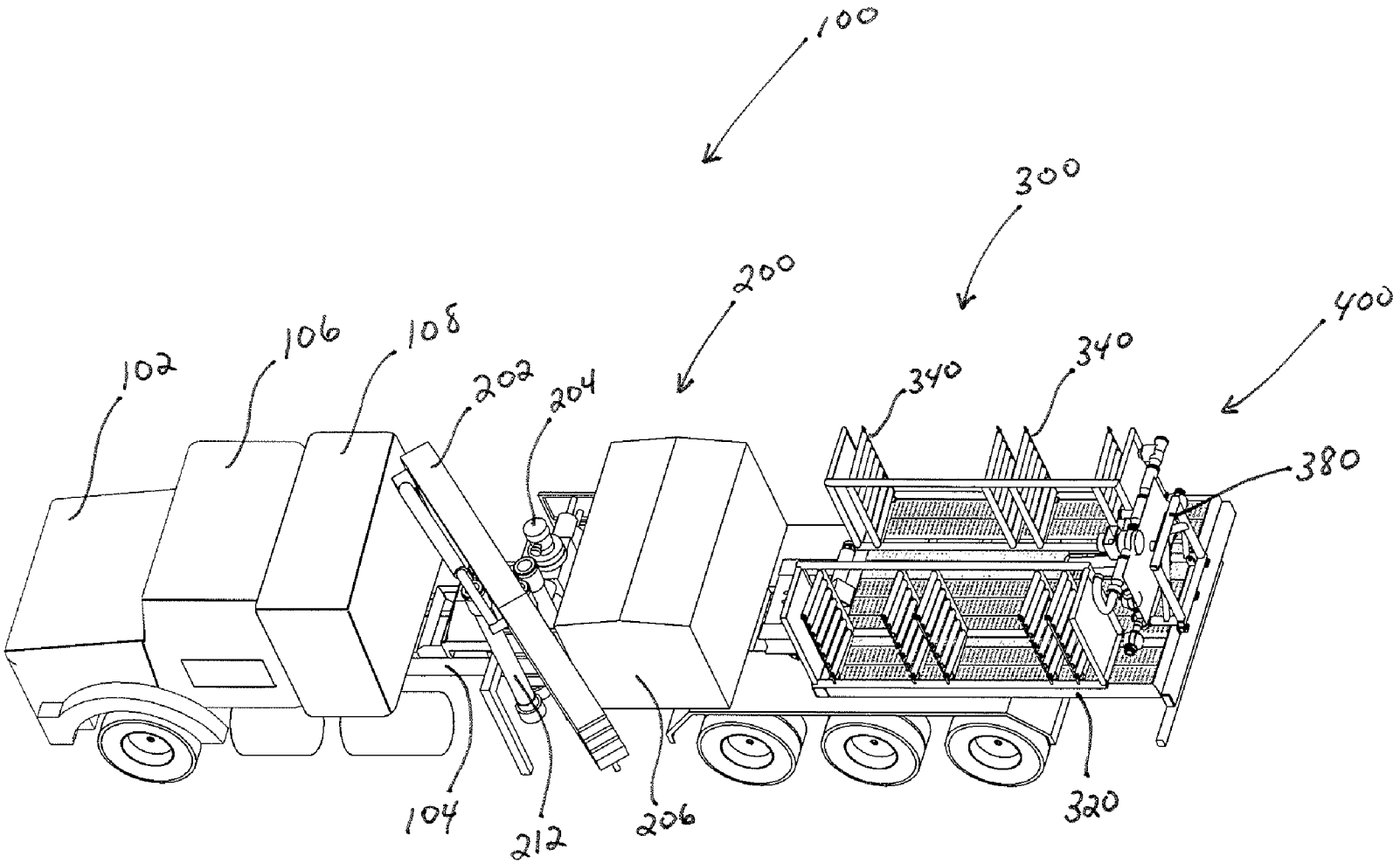
FIG. 2 shows a left-side perspective view of the combined FTC support system shown in FIG. 1, wherein the iron skid is positioned on the truck bed.
Figure 4:
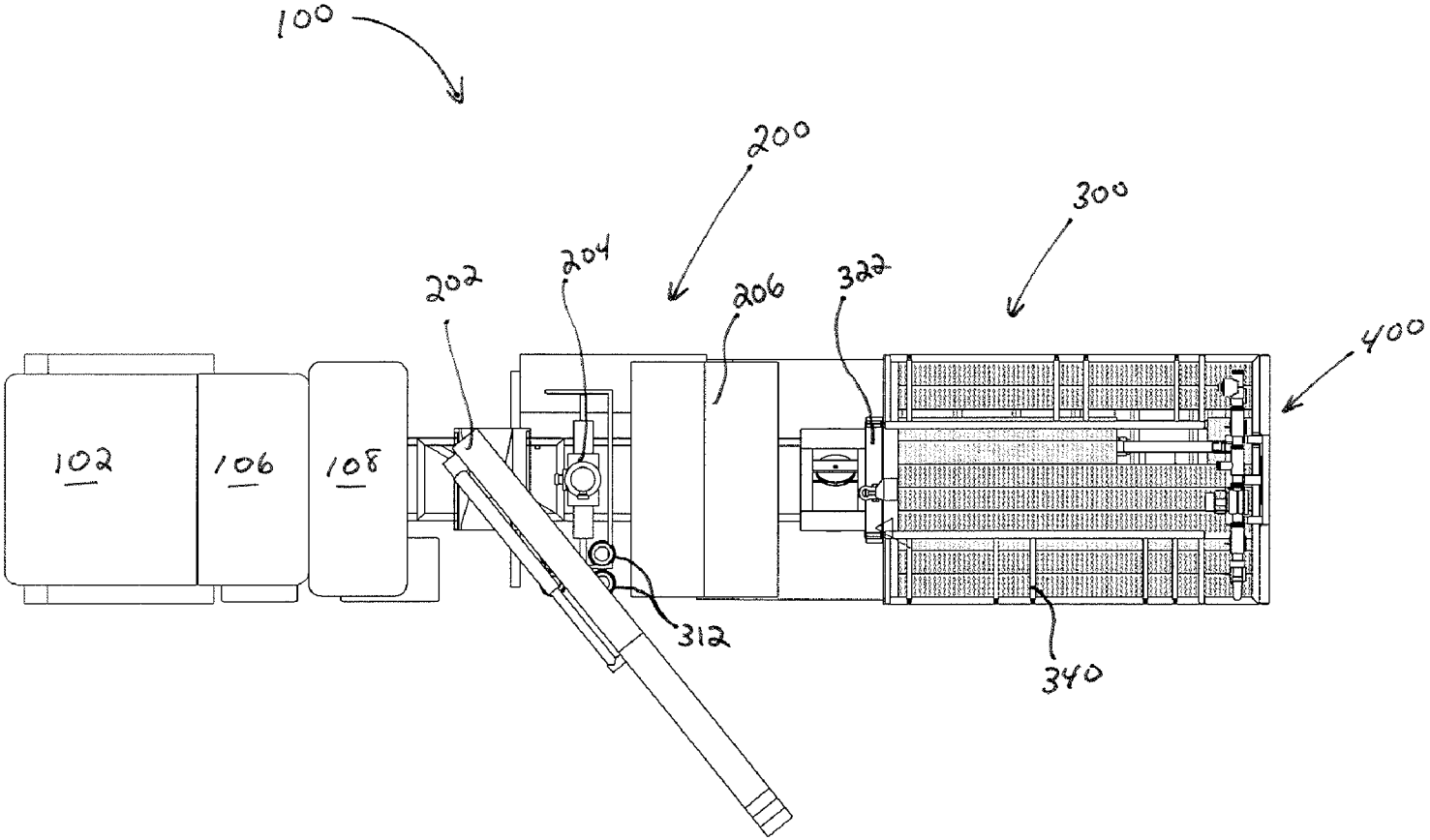
FIG. 4 shows top plan view of the combined FTC support system shown in FIGS. 2 and 3.

During transport between well sites, the iron skid 300 is secured to the truck bed 104, as shown in FIGS. 2 to 4, by a lock pin or other securing means known in the art. When the iron skid 300 is to be deployed or articulated to the ground, the lock pin or other securing means is released, and the skid is lowered in the following manner.

As the hydraulic cylinders 316 raise the first end 315 of the elevating ramp 310, as shown in FIG. 1, the elevating ramp 310 pivots on hinges 120. This allows for hydraulic ram 312, which is fixedly connected to the elevating ramp 310 and iron skid 300, to move the iron skid 300 off of the elevating ramp 310 and onto the ground. Movement of the iron skid 300 off the truck bed and onto the ground is assisted as well by a live roll or rollers 322 attached to the iron skid 300. Rollers 322 engage with the elevating ramp 310 and act as a passive retarder as the iron skid is moved from the first end 315 of the elevating ramp to the ground. Once the skid 300 is on the ground, the iron components are at waist height, making them much easier and safer to handle by workers.

As can be appreciated by one skilled in the art, the operation is performed in reverse to raise the iron skid 300 back onto the truck bed 104.

With respect to the actual iron skid 300, it comprises an iron rack or racks 340 for securely carrying high pressure treating iron components, such as high pressure tubing, joints and connectors, as well as chicsans and any other pieces need to complete a fracturing operation. The high pressure treating iron is typically 10', 6', 4' and 2' in length and 2" and 3" in circumference.

The skid 300 further comprises a bed gate 380, connected to a hydraulic cylinder 382, operable to move the bed gate between a closed position, shown in FIGS. 1-3, and an open position, shown in FIG. 4.

Manifold

The manifold 400 is mounted to the bed gate 380 and pivots with the bed gate. As the bed gate is placed in a lowered position, as shown in FIGS. 1, 5, 6, and 7, the manifold is ready for integration in the well fracturing system for treating the well. In the raised position, as shown in FIGS. 2 to 4, the manifold is ready for transport. The manifold 400 generally comprises an arrangement of valves designed to control and distribute fluid flow. Typically, the manifold comprises high pressure 3" chicsan 402, high pressure 2" valves 404 and 406, and high pressure 3" check valve 408.

The previous detailed description is provided to enable any person skilled in the art to make or use the applicant's combined FTC support system. Various modifications to the embodiments described will be readily apparent to those skilled in the art, and the generic principles defined herein may be applied to other embodiments without departing from the spirit or scope of the combined FTC support system described herein. Thus, the present combined FTC support system is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A combined system for treating an oil or gas well, comprising:

a truck, having a truck bed attached thereto; and a fracturing support unit and an iron skid mounted on the truck bed, the iron skid comprising a manifold, the fracturing support unit comprising well head control equipment including at least one blow-out preventer.

2. The combined system according to claim 1, wherein said fracturing support unit further comprises a crane for manipulating said well head control equipment.

3. The combined system according to claim 1, wherein said fracturing support unit further comprises an air compressor.

4. The combined system according to claim 1, wherein said iron skid comprises a rack for holding high pressure treating iron components.

5. The combined system according to claim 1, wherein said iron skid is an articulating iron skid, which is configured for lowering from said truck bed to ground level.

6. The combined system according to claim 5, wherein said articulating iron skid is mounted on an elevating ramp, said elevating ramp being pivotally connected to said truck bed, said iron skid being slidably connected to said elevating ramp.

7. The combined system according to claim 6, wherein said elevating ramp is pivotally connected to said truck bed by a pair of hinges and said elevating ramp is further connected to said truck bed by a pair of hydraulic cylinders for raising and lowering a first end of said elevating ramp from a first lowered position to a second raised position.

8. The combined system according to claim 7, wherein said articulating iron skid is configured to slide from the first end of said elevating ramp to a second end of said elevating ramp when said first end of said elevating ramp is raised to said second raised position by said hydraulic cylinders, and wherein said elevating ramp includes a hydraulic ram connected to said iron skid for assisting movement of said iron skid from said first end of said elevated ramp to said second end of said elevating ramp.

9. The combined system according to claim 8, wherein said articulating iron skid has rollers adapted to engage with said elevating ramp as said iron skid is moved from said first end of said elevating ramp to said second end of said elevating ramp.

10. The combined system according to claim 5, wherein said iron skid provides said iron components at waist height when said iron skid is lowered to ground level.

11. The combined system according to claim 1, wherein said manifold comprises an arrangement of valves designed to control and distribute fluid flow to the well.

12. The combined system according to claim 1, wherein said manifold is pivotally connected to said iron skid for movement between a raised position for transport and a lowered position wherein said manifold is ready for treating the well.

13. An articulating iron skid attachable to a truck bed for use in treating an oil or gas well, the iron skid comprising:

a rack bed and a rack mounted thereto for holding high pressure treating iron components;

an elevating ramp designed for pivotal connection to the truck bed, the rack bed being slidably connected to said elevating ramp;

a pair of hydraulic cylinders for further connecting said elevating ramp to the truck bed, said cylinders for raising and lowering a first end of said elevating ramp between a first lowered position to a second raised position;

wherein said articulating iron skid is configured to slide from said first end of said elevating ramp to a second end of said elevating ramp when said first end of said elevating ramp is raised to said second raised position by said hydraulic cylinders, thereby lowering the iron skid from the truck bed to ground level.

14. The articulating iron skid of claim 13, wherein said elevating ramp includes a hydraulic ram connected to said iron skid for assisting movement of said iron skid from said first end of said elevated ramp to said second end of said elevating ramp.

15. The articulating iron skid of claim 13, wherein said iron skid includes rollers adapted to engage with said elevating ramp as said iron skid is moved from said first end of said elevating ramp to said second end of said elevating ramp.

16. The articulating iron skid of claim 13, wherein said iron skid provides said iron components at waist height when said iron skid is lowered to ground level.

17. The articulating iron skid of claim 13, wherein said iron skid includes a manifold having an arrangement of valves designed to control and distribute fluid flow to the well.

18. The articulating iron skid of claim 17, wherein said manifold is pivotally connected to said iron skid for movement between a raised position for transport and a lowered position wherein said manifold is ready for treating the well.

19. A combined system for treating an oil or gas well, comprising:

a truck, having a truck bed attached thereto;

a fracturing support unit and an iron skid mounted on the truck bed, the iron skid comprising a manifold and a rack for holding high pressure treating iron components.

20. A combined system for treating an oil or gas well, comprising:

a truck, having a truck bed attached thereto;

a fracturing support unit and an iron skid mounted on the truck bed, the iron skid comprising a manifold, wherein said iron skid is an articulating iron skid, which is configured for lowering from said truck bed to ground level, and wherein said articulating iron skid is mounted on an elevating ramp, said elevating ramp being pivotally connected to said truck bed, said iron skid being slidably connected to said elevating ramp.

21. A combined system for treating an oil or gas well, comprising:

a truck, having a truck bed attached thereto;

a fracturing support unit and an iron skid mounted on the truck bed, the iron skid comprising a manifold, wherein the iron skid is an articulating iron skid, which is configured for lowering from said truck bed to ground level to provide said iron components at waist height when the iron skid is lowered to ground level.

22. A combined system for treating an oil or gas well, comprising:

a truck, having a truck bed attached thereto;

a fracturing support unit and an iron skid mounted on the truck bed, the iron skid comprising a manifold pivotally connected to said iron skid for movement between a raised position for transport and a lowered position wherein the manifold is ready for treating the well.

* * * * *